US006761807B2

(12) United States Patent
Velez, Jr. et al.

(10) Patent No.: US 6,761,807 B2
(45) Date of Patent: Jul. 13, 2004

(54) MOLDED TOOLING FOR USE IN AIRFOIL STRIPPING PROCESSES

(75) Inventors: Ramon M. Velez, Jr., Windsor, CT (US); Thomas M. Morin, Terryville, CT (US); John S. Planeta, Colchester, CT (US); Ronald R. Soucy, East Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 138 days.

(21) Appl. No.: 10/094,701

(22) Filed: Mar. 9, 2002

(65) Prior Publication Data

US 2003/0168350 A1 Sep. 11, 2003

(51) Int. Cl.[7] ..... C25D 17/00
(52) U.S. Cl. ..... 204/224 M; 204/297.01
(58) Field of Search ..... 204/224 M, 297.01; 205/717

(56) References Cited

U.S. PATENT DOCUMENTS 3,779,879 A * 12/1973 Scott ..... 205/717
4,128,463 A * 12/1978 Formanik ..... 205/717
4,638,602 A * 1/1987 Cavalieri ..... 51/217 R
5,607,561 A 3/1997 Gruver et al.
5,792,267 A * 8/1998 Marszal et al. ..... 118/500
6,162,335 A 12/2000 Jordan et al.
6,352,636 B1 * 3/2002 Wei et al. ..... 205/717
6,428,683 B1 * 8/2002 Jaworowski et al. ..... 205/673
6,599,416 B2 * 7/2003 Kool et al. ..... 205/717

* cited by examiner

*Primary Examiner*—Donald R. Valentine
(74) *Attorney, Agent, or Firm*—Bachman & LaPointe, P.C.

(57) ABSTRACT

The present invention relates to a molded tooling fixture for supporting an airfoil during an electrochemical stripping process. The tooling fixture comprises a holder for receiving the airfoil, which holder has a slot in which a serrated portion of the airfoil is positioned. The holder is formed from an electrically non-conductive material such as molded plastic. The first slot has at least one serrated surface which mates with at least one serration on the airfoil. The fixture further includes a support arm on which the holder is supported. The support arm is also formed from an electrically non-conductive material such as molded plastic. Still further, the fixture includes a rod formed from an electrically conductive material which sits in a groove in the support arm and which contacts a lower surface of the airfoil.

11 Claims, 7 Drawing Sheets

MOLDED TOOLING FOR USE IN AIRFOIL STRIPPING PROCESSES

BACKGROUND OF THE INVENTION

The present invention relates to a molded tooling fixture for use in a process for electrochemically stripping coatings from turbine engine airfoils.

Gas turbine engines in aircraft are taken out of service at periodic intervals and regular maintenance service is performed on them. Part of the regular repair sequence for the blades and vanes (individually or collectively referred to hereafter as "airfoils") of these engines includes the removal and then replacement of the worn coatings from their surfaces. These coatings are usually either an aluminide coating or an MCrAlY coating. The underlying base metal of the airfoils is generally made of either a nickel base alloy or a cobalt base alloy. These coatings provide the airfoils with a thermal barrier to the hot corrosive environment in which these airfoils operate.

In the past, these aluminide and MCrAlY coatings were removed from airfoils by soaking the airfoils either in nitric acid solutions or in hydrochloric acid solutions in high concentrations for up to six hours at elevated temperatures. The soaking process however is disadvantageous in several respects. It is extremely labor intensive and can produce non-uniform and unpredictable results. It can also damage or destroy airfoils if improperly carried out. Furthermore, each airfoil requires extensive masking to protect areas sensitive to the acid soaking solution. Such areas include internal surfaces and the root section of the airfoil. These masking operations are costly, add significant time to the repair process and, if not properly carried out, can lead to damaged or destroyed parts. Still further, these soaking processes may result in extensive amounts of acidic waste solution that must be properly disposed of as well as have a long cycle time and require relatively large amounts of energy to heat the acidic solutions.

A process for electrochemically stripping a coating from an airfoil is described in U.S. Pat. No. 6,176,999 to Jaworowski et al., which is hereby incorporated by reference herein. In this process, an airfoil to be stripped is immersed in an electrochemical acid bath for a sufficient period of time to remove the coating from the airfoil while the airfoil in the electrochemical acid bath is maintained with a controlled absolute electrical potential with respect to a reference electrode. Prior to being immersed in the bath, the airfoil is masked to cover any acid sensitive surfaces. The airfoil parts are affixed to an insulating fixture at the root section of the airfoil. The insulating fixture is made of titanium or another noble metal material.

Despite the advancements in electrochemical stripping of airfoils, there remains a need for tooling fixtures which protect the root section and adjacent serrations of an airfoil from etching damage.

SUMMARY OF THE INVENTION

Accordingly, it is an object of the present invention to provide a tooling fixture which protects the root section and adjacent serrations during an electrochemical stripping operation.

It is a further object of the present invention to provide a tooling fixture as above which is easily installed and which achieves better stripping results.

The foregoing objects are attained by the tooling fixture of the present invention.

In accordance with the present invention, a tooling fixture for supporting an airfoil during an electrochemical stripping process broadly comprises a holder for receiving the airfoil, which holder has a first slot in which a serrated portion of the airfoil is positioned. The holder is formed from an electrically non-conductive material such as molded plastic. The first slot has at least one serrated surface which mates with at least one serration on the airfoil. The fixture further includes a support arm on which the holder is supported. The support arm is also formed from an electrically non-conductive material such as molded plastic. Still further, the fixture includes a rod formed from an electrically conductive material which sits in a groove in the support arm and which contacts a lower surface of the airfoil.

Other details of the tooling fixture of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
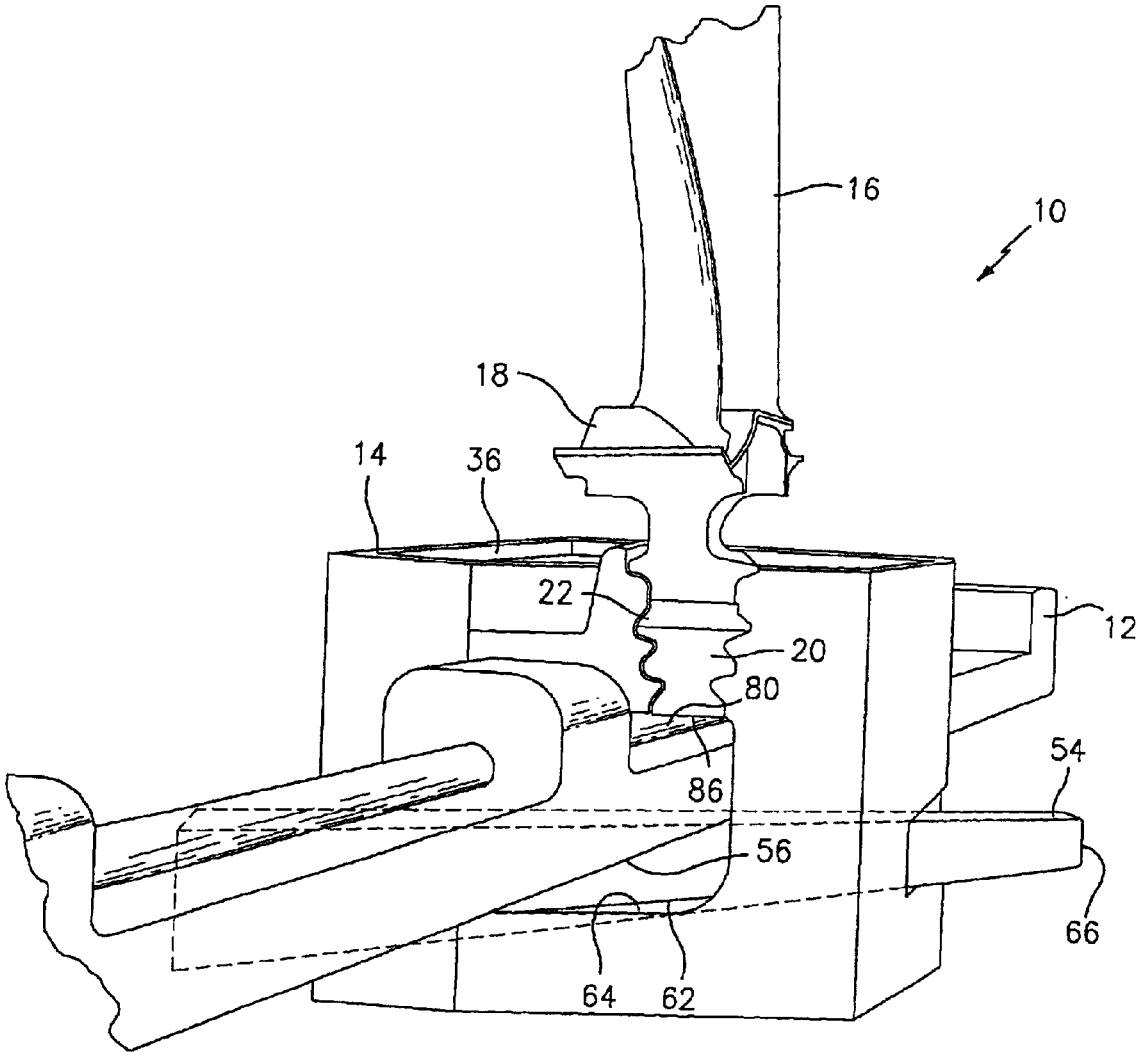
FIG. 1 is a perspective view of a tool in accordance with the present invention.
Figure 2:
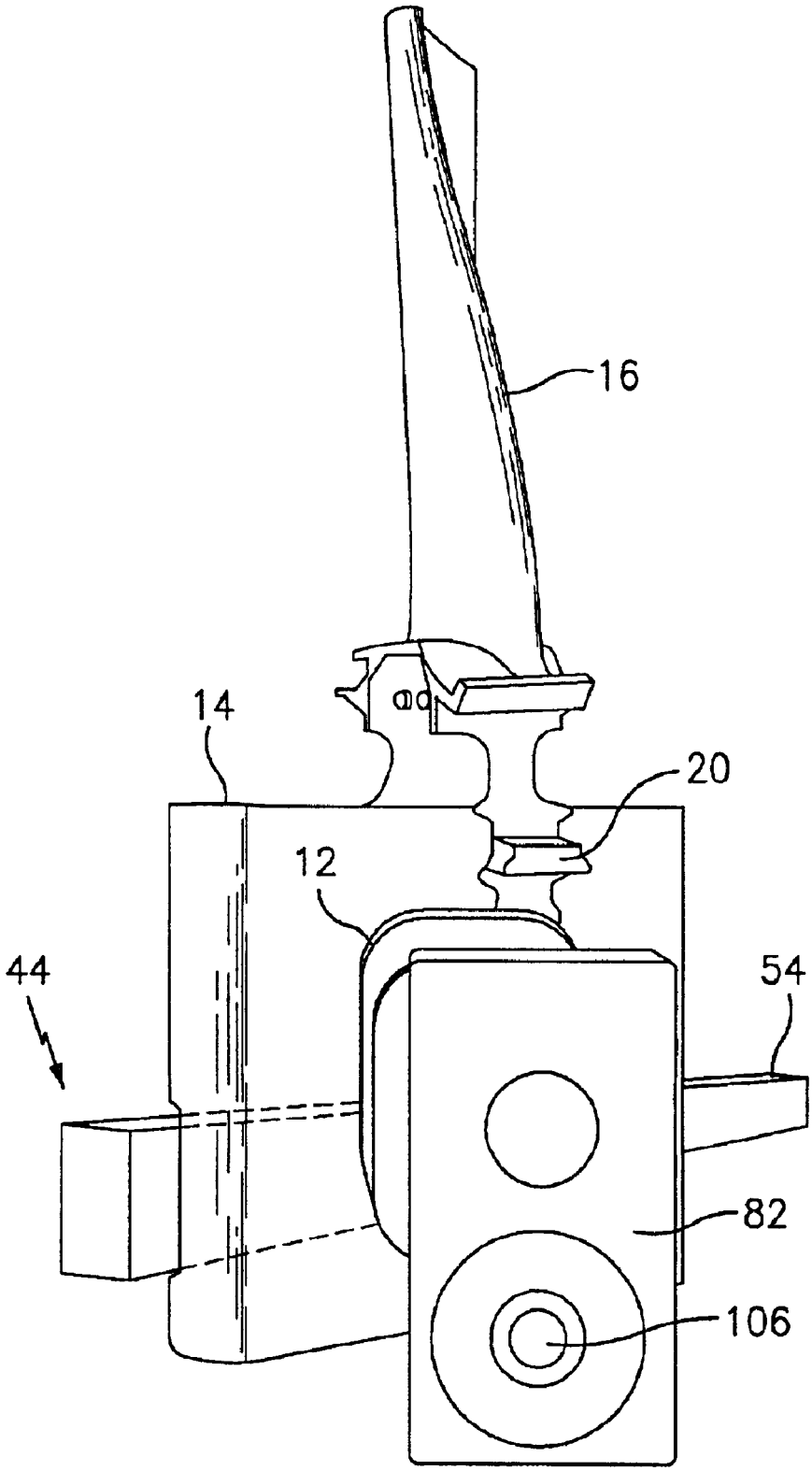
FIG. 2 is an end view of the tool of FIG. 1.

Referring now to the drawings, FIGS. 1 and 2 illustrate a tooling fixture 10 in accordance with the present invention. The tooling fixture includes a support arm 12 and a part holder 14 positioned on the support arm 12. The holder 14 supports a part such as an airfoil 16 in a desired position. As can be seen from FIG. 1, the airfoil 16 has a platform 18 and a root portion 20 with a plurality of serrations 22 on each side of the root portion 20.

Figure 7:
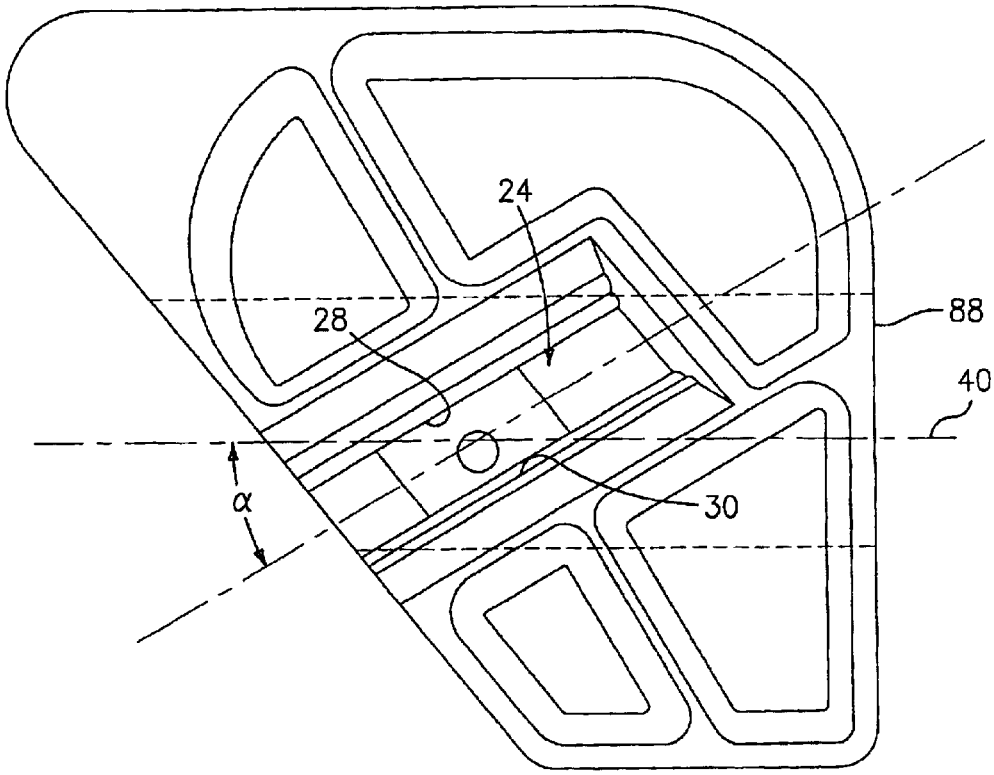
FIG. 7 is a top view of the part holder of FIG. 3.

The part holder 14 is formed from an electrically non-conductive material such as molded plastic. The part holder 14 as can be seen from FIGS. 3, 4, and 7 has a first slot 24 which extends along an axis 26. The slot 24 has two side walls 28 and 30. Each of the walls 28 and 30 has one or more serrations 32 and 34 respectively which match and mate with the serrations 22 on the root portion 20 of the airfoil 16. The use of the slot serrations 32 and 34 helps support the airfoil 16 so that it extends substantially perpendicular from the surface 36 of the part holder 14.

Figure 3:
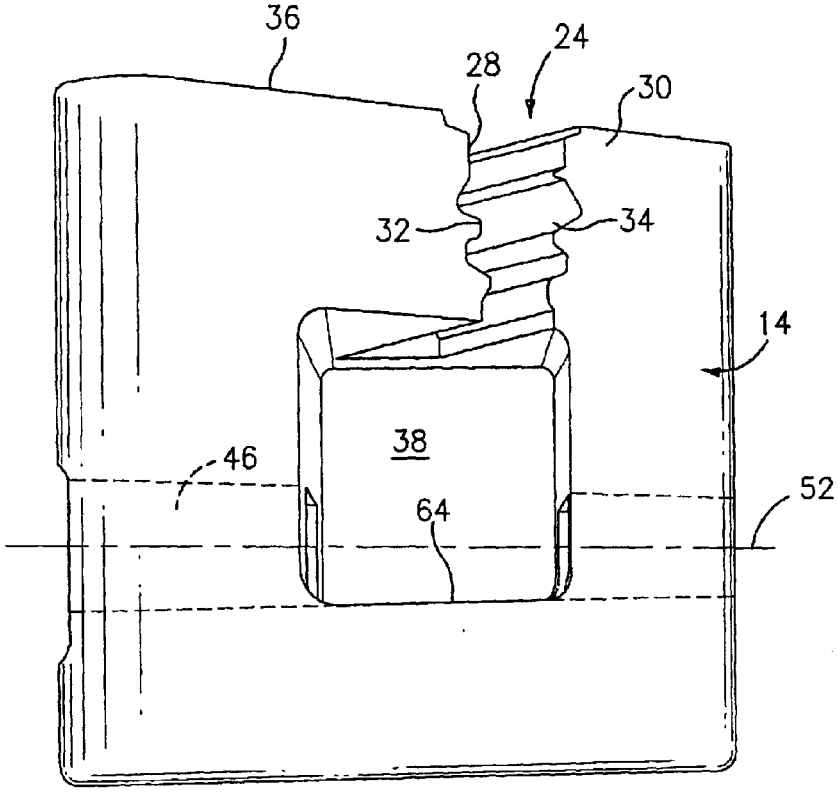
FIG. 3 is a front view of a part holder used in the tool of the present invention.
Figure 4:
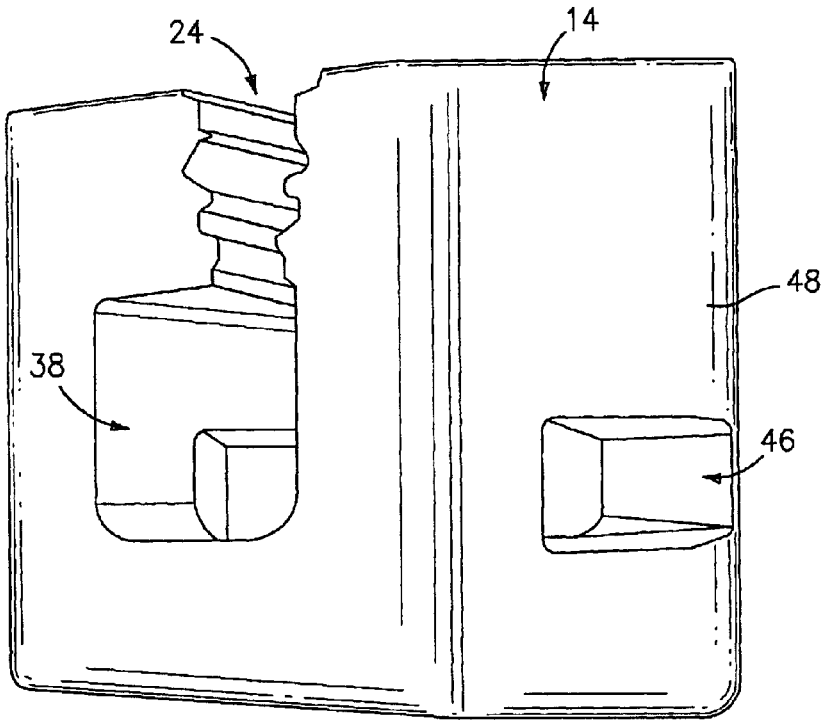
FIG. 4 is a side view of the part holder of FIG. 3.
Figure 5:
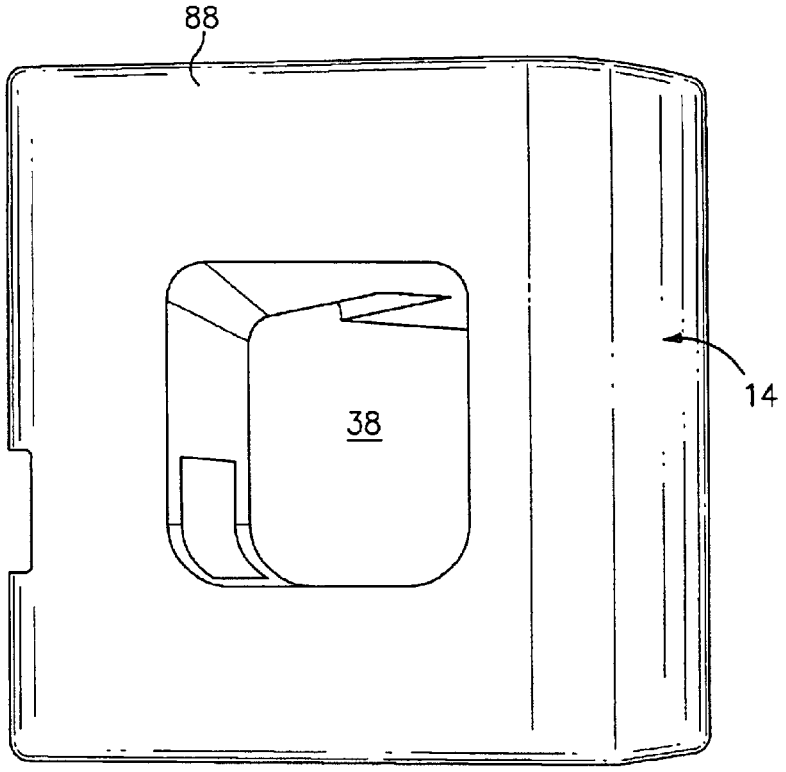
FIG. 5 is a rear view of the part holder of FIG. 3.
Figure 6:
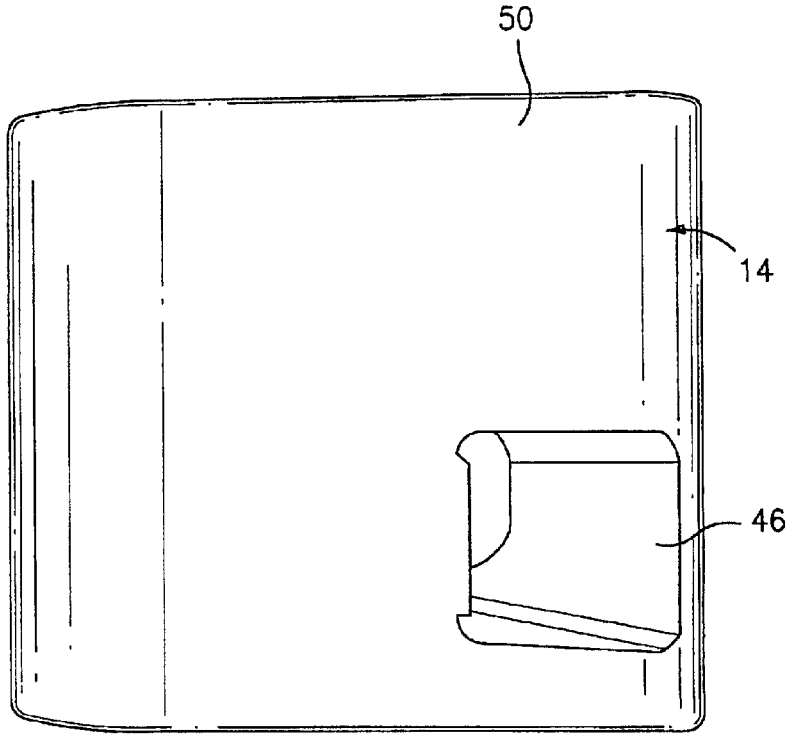
FIG. 6 is another side view of the part holder of FIG. 3.

The part holder 14, as can be seen in FIGS. 3 and 5, has a second slot 38 which extends along an axis 40. The axis 40 is at an angle $\alpha$ with respect to the axis 26. The angle $\alpha$ is such that the airfoil 16 is oriented so that a line drawn from its leading edge to its trailing edge is substantially perpendicular to the bottom 103 of a stripping tank 100 and its longitudinal axis extending from the root section 20 to the tip of the airfoil is substantially parallel to the bottom 103 of the stripping tank 100. The second slot 38 is dimensioned to allow the holder 14 to receive the support arm 12 and slide relative thereto to a desired location adjacent one of the abutments 42 on the support arm 12.

To secure the part holder 14 in a desired position relative to the support arm 12, a locking mechanism 44 is provided. The locking mechanism 44 includes a third slot 46 which extends from one side 48 of the part holder 14 to an opposite side 50 of the part holder 14. The third slot 46 extends along an axis 52 which is at an angle to each of the axes 26 and 40. The locking mechanism 44 further includes a wedge 54 which extends through the slot 46 and which is also formed from an electrically non-conductive material such as molded plastic. The wedge 54 abuts against a lower surface 56 of the support arm 12 and causes a contact rod 80 housed in the support arm 12 to come into contact with a lower surface 86 of the airfoil 16. The bottom surface 62 of the wedge 54 contacts a lower surface 64 of the second slot 38. The wedge 54 may be removed from the slot 46 by hitting an end 66 with a hammer or other tool and dislodging the wedge 54 from its locked position.

While it is preferred to use a wedge type locking mechanism 44, other clamping and locking mechanisms may be used to position the part holder 14 on the support arm 12.

Figure 8:
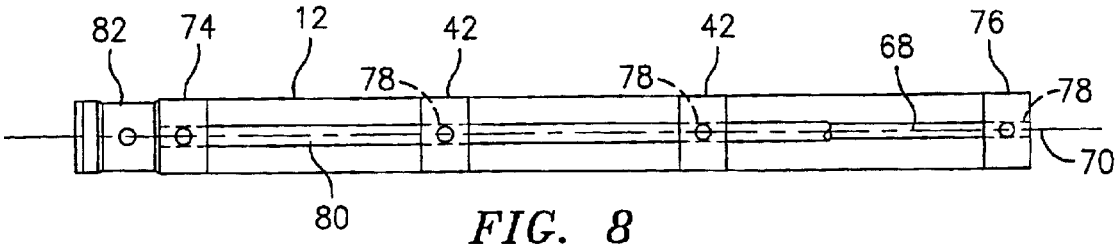
FIG. 8 is a top view of a support arm used in the tool of the present invention.
Figure 9:
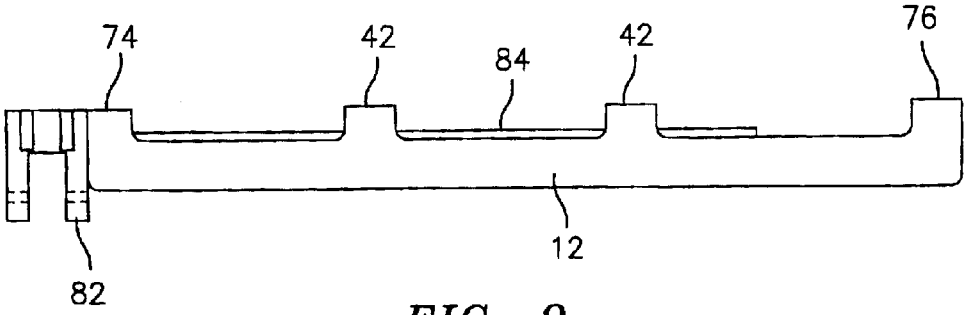
FIG. 9 is a side view of the support arm of FIG. 8.

Referring now to FIGS. 8 and 9, the support arm 12 has a groove 68 which extends along the longitudinal axis 70 of the arm 12. When the tooling fixture 10 is assembled, the longitudinal axis 70 is parallel to the second slot axis 40. The support arm 12 further has a plurality of integrally formed semi-cylindrical abutments 42 and two raised end walls 74 and 76. Each of the abutments 42 and the end walls 74 and 76 has an aperture 78 formed therein.

As previously mentioned, the support arm 12 further includes an electrical contact rod 80 with a U-shaped bracket 82 at one end. The U-shaped bracket 82 may be integrally formed with the rod 80 or may be welded thereto. The rod 80 and the bracket 82 are formed from an electrically conductive material such as a ferrous alloy or a non-ferrous alloy. The rod 80 passes through the apertures 78 in the end walls 74 and 76 and the abutments 42 and rests within the groove 68. The rod 80 may be secured in place using any suitable means known in the art. For example, holes (not shown) can be drilled in the abutments 42 and the end walls 74 and 76 and screws (not shown) can be inserted into the holes to contact and secure the rod 80 in place. When the part holder 14 is positioned on the support arm 12 and locked into place, as previously mentioned, a top surface 84 of the rod, which is preferably a flat surface, contacts a lower surface 86 of the airfoil 16.

In a preferred embodiment of the tooling fixture 10 of the present invention, three part holders 14 are positioned on the support arm 12. Two of the part holders 14 have a rear wall 88 which contacts one of the abutment members 72. The third part holder 14 has a rear wall 88 which contacts the end wall 76.

Figure 10:
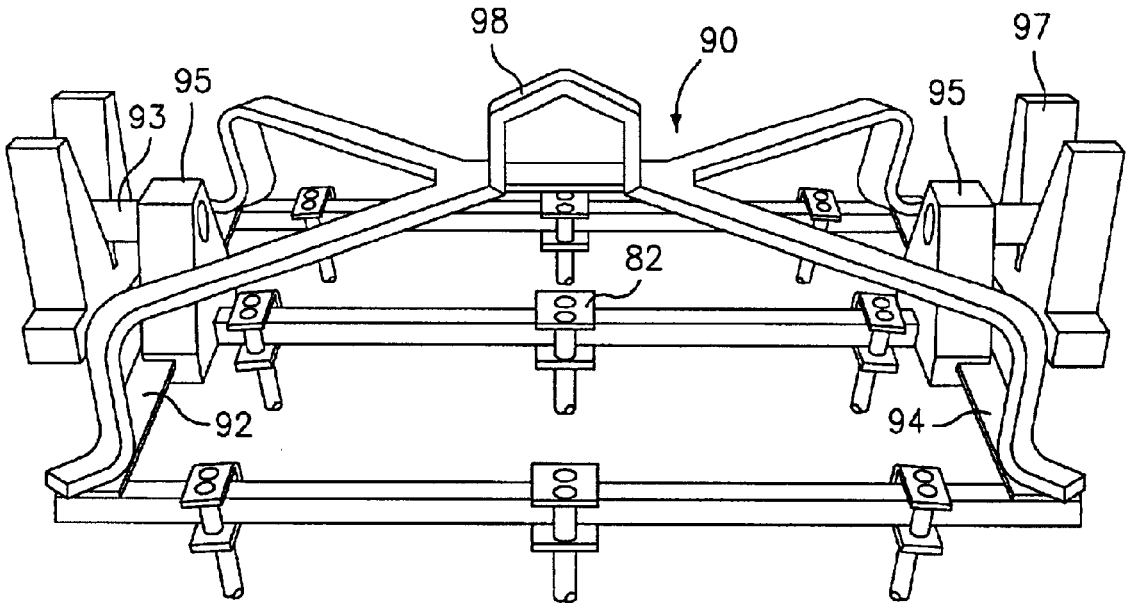
FIG. 10 illustrates a support for the tool of the present invention.

In order to electrolytically strip the coating from the airfoil 16, each tooling fixture 10 is mounted to a grid assembly 90 as shown in FIG. 10. The grid assembly includes a pair of side bars 92 and 94 and central support members 95. Each central support member 95 has an outwardly extending pin 93 to allow the grid assembly 90 to be supported by V-shaped support structures 97 mounted to the top of the stripping tank 100. The grid assembly 90 also has support bars 96 extending between the side bars 92 and 94 and joined to one of the side bars 92 and 94 at each respective end. The side bars 92 and 94 and the support bar(s) 96 are formed from an electrically conductive material. A handle assembly 98 is connected to the side bars 92 and 94 to allow the grid assembly 90 to be lifted out of and dropped into a stripping tank 100.

Each tooling fixture 10 is mounted to a respective support bar 96 by the U-shaped bracket 82 affixed to an end of the rod 80. Each U-shaped bracket 82 can be joined to a respective support bar 96 using any suitable means known in the art. For example, each leg 102 and 104 of the U-shaped bracket 82 may have a threaded aperture 106 through which a threaded clamping bolt can be inserted and secured in place by a nut.

Figure 11:
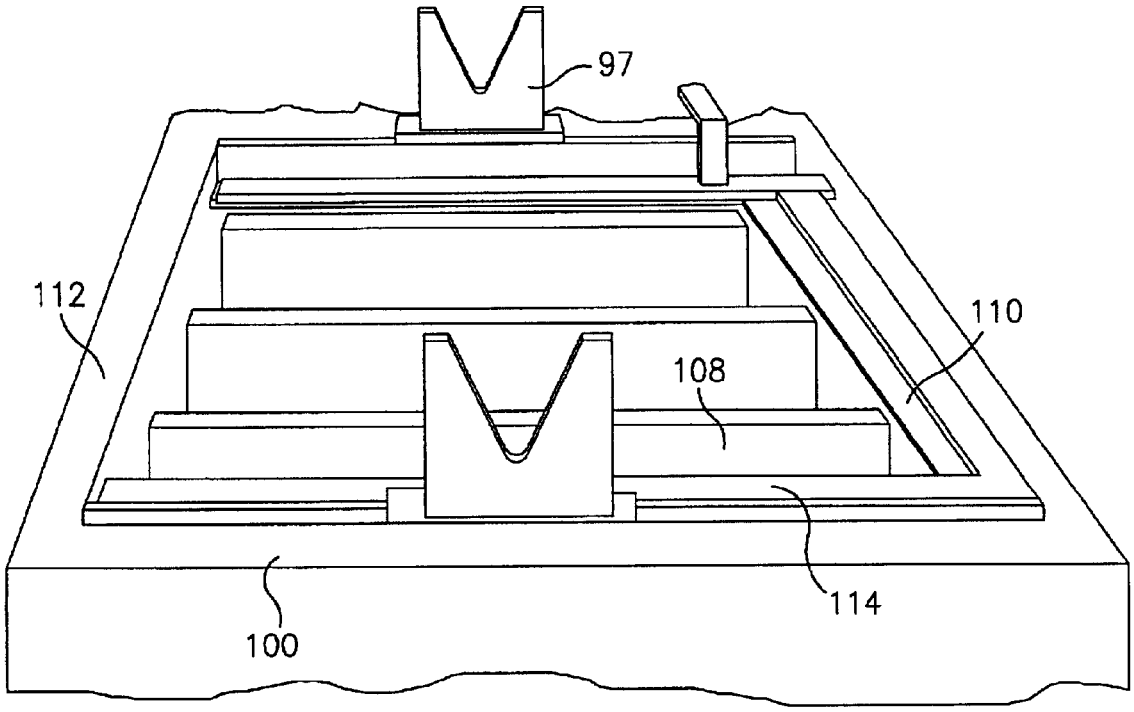
FIG. 11 illustrates a tool in accordance with the present invention immersed in a stripping bath.
Figure 12:
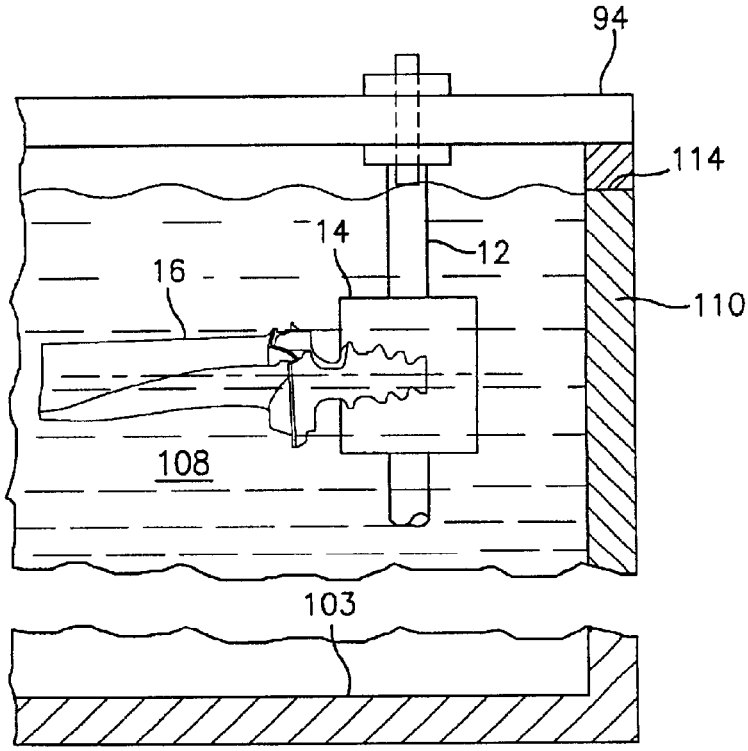
FIG. 12 is a partial sectional view of the stripping tank of FIG. 11.

Referring now to FIG. 11, the stripping tank 100 has a plurality of graphite plates 108 extending from one side 110 of the tank to an opposite side 112. The graphite plates 108 during the stripping process are electrically connected to a negative terminal of a power source to act as cathodic elements. Surrounding the upper periphery of the tank 100 is a rectangularly or U-shaped shaped member 114 formed from an electrically conductive material. During the stripping operation, the member 114 is electrically connected to the positive terminal of a power source.

Prior to stripping, the grid assembly 90 is placed on top of the member 114 so that the side bars 92 and 94 are in contact therewith. The grid assembly is oriented so that each airfoil has an axis 101 from its root portion to its tip portion which extends parallel to the plates 108 and parallel to the bottom wall 103 of the tank 100. It has been found that this orientation is highly desirable from the standpoint of obtaining the most complete removal of the coating being stripped. During the stripping process, each airfoil 16 acts as an anode via the electrical connection between the member 114, the side bars 92 and 94, the support bar(s) 96, the U-shaped bracket 82, and the rod 90 in contact with the lower airfoil surface 86.

The tooling fixture 10 of the present invention has a number of advantages. First, since the part holder 14 is preferably formed from molded plastic, the part holder 14 is relatively inexpensive to manufacture and reusable. Second, since the part holder 14 has a slot 24 with serrated side walls 28 and 30 which match the serrations 22 on the airfoil root portion 20, the likelihood of causing damage to the root portion 20 and the serrations 22 during the stripping operation, such as etching and tool marks, is substantially avoided. Third, the part holder 14 provides a protective mask which prevents unnecessary exposure of the root portion 20 to the acid bath solution in which the stripping occurs. Fourth, the use of the part holder 14 is less labor intensive than former masking procedures. Fifth, the part holder 14 supports the airfoil 16 at the best possible angle for the stripping operation.

It is apparent that there has been provided in accordance with the present invention molded tooling for use in airfoil stripping processes which fully satisfies the objects, means and advantages set forth hereinbefore. While the present invention has been described in the context of specific embodiments thereof, other alternatives, modifications, and variations will become apparent to those skilled in the art. Accordingly, it is intended to embrace those alternatives, modifications, and variations as fall within the broad scope of the appended claims.

What is claimed is:

1. A system for stripping coatings from a plurality of airfoils comprising:

a tank containing an acidic bath solution;

a plurality of cathodic members positioned within said tank;

an electrically conductive member placed on a top surface of said tank;

an electrically conductive grid assembly placed in contact with said electrically conductive member;

said grid assembly having a plurality of support bars;

a plurality of tooling fixtures attached to said support bars; and each tooling fixture holding at least one airfoil member in said tank so that each said airfoil member has a longitudinal axis substantially parallel to a bottom wall of said tank.

2. A system according to claim 1, wherein each said tooling fixture comprises:

a support arm;

at least one airfoil holder positioned on said support arm; and each said airfoil holder being formed from an electrically non-conductive material and having a first slot in which a serrated portion of said airfoil is positioned.

3. A system according to claim 2, wherein said first slot has a pair of side walls and each of said side walls has a serrated surface which matches serrations on a root portion of said airfoil.

4. A system according to claim 3, wherein said guide arm has at least one abutment and said at least one airfoil holder has a rear wall which abuts said at least one abutment.

5. A system according to claim 2, further comprising a plurality of airfoil holders positioned on said support arm.

6. A system according to claim 2, further comprising a contact rod extending through said support arm and having a contact surface which contacts a lower surface of each said airfoil supported by each said airfoil holder.

7. A system according to claim 6, wherein said contact surface is flat.

8. A system according to claim 6, wherein each said tooling fixture is attached to a respective one of said support bars by a U-shaped bracket attached to an end of the contact rod.

9. A system according to claim 1, wherein:

each said cathode comprises a graphite plate extending from one side wall of said tank to an opposite side wall of said tank; and said longitudinal axis of each said airfoil extending parallel to each said graphite plate.

10. A system according to claim 1, wherein a respective tooling fixture is adapted to support each said airfoil member so as to be oriented in said tank so that a line extending from a leading edge of the airfoil member to a trailing edge of the airfoil member is substantially perpendicular to the bottom wall of the tank.

11. A system for stripping coatings from a plurality of airfoils comprising:

a tank for holding an acidic bath solution;

a plurality of cathodic members positioned within said tank;

an electrically conductive member placed on a top surface of said tank;

an electrically conductive grid assembly placed in contact with said electrically conductive member;

said grid assembly having a plurality of support bars;

a plurality of tooling fixtures attached to said support bars; and each of said tooling fixtures having means for holding at least one airfoil member in said tank so that each said airfoil member has a longitudinal axis substantially parallel to a bottom wall of said tank.

* * * * *